US009440280B1

(12) United States Patent
Utecht et al.

(10) Patent No.: US 9,440,280 B1
(45) Date of Patent: Sep. 13, 2016

(54) PORTABLE HYDRAULIC HOUSE MEMBER CRIMPING DEVICE

(71) Applicants: Peter W. Utecht, Hartford, WI (US); Peter W. Utecht, Jr., Colgate, WI (US)

(72) Inventors: Peter W. Utecht, Hartford, WI (US); Peter W. Utecht, Jr., Colgate, WI (US)

( * ) Notice: Subject to any disclaimer, the term of this patent is extended or adjusted under 35 U.S.C. 154(b) by 0 days.

(21) Appl. No.: 15/083,741

(22) Filed: Mar. 29, 2016

(51) Int. Cl.
*B21D 39/04* (2006.01)
*B25B 27/10* (2006.01)

(52) U.S. Cl.
CPC ..... *B21D 39/048* (2013.01); *B25B 27/10* (2013.01)

(58) Field of Classification Search
CPC ..... B25B 27/0028; B25B 27/0092; B25B 27/28
See application file for complete search history.

(56) References Cited

U.S. PATENT DOCUMENTS 4,240,191 A * 12/1980 Schroyer ..... B25B 27/0021 29/252
4,993,135 A * 2/1991 Seeley ..... B65B 51/04 227/120
5,410,903 A * 5/1995 Schneider ..... B25B 25/005 29/243.56
5,890,270 A * 4/1999 Oetiker ..... B21D 39/048 29/235
6,324,884 B1 * 12/2001 Barjesteh ..... B21D 39/046 29/237
7,640,780 B2 1/2010 Ruland
8,336,177 B2 * 12/2012 Vernasca ..... B21D 39/048 29/235
8,661,643 B1 3/2014 Utecht et al.
2010/0107393 A1 * 5/2010 Vernasca ..... B21D 39/048 29/237

* cited by examiner

*Primary Examiner* — Lee D Wilson
(74) *Attorney, Agent, or Firm* — Donald J. Ersler

(57) ABSTRACT

A portable crimping device preferably includes a support base, a hydraulic cylinder, a hand hydraulic pump, a crimping device and a pair of mounting brackets. The pair of mounting brackets are attached to the support base. An output of the hand hydraulic pump is connected to an input of the hydraulic cylinder. The hand hydraulic pump and the hydraulic cylinder are retained by the pair of mounting brackets. The crimping device preferably includes a base yoke member, a die pivot member and an actuation base. A pair of crimp dies are retained in the base yoke member and the die pivot member. The actuation base is slidably retained in the base yoke member. The die pivot member is engaged with the die pivot member. Pumping of the hand hydraulic pump causes the actuation base to crimp an object placed between the pair of crimp dies.

20 Claims, 3 Drawing Sheets

PORTABLE HYDRAULIC HOUSE MEMBER CRIMPING DEVICE

BACKGROUND OF THE INVENTION

1. Field of the Invention

The present invention relates generally to hydraulic hoses and more specifically to a portable hydraulic hose mender crimping device, which allows a hose mender or other hose fitting to be attached to a hose with a portable device.

2. Discussion of the Prior Art

There are numerous devices in the art for swaging a fitting on the end of a hose. U.S. Pat. No. 6,324,884 to Barjesteh et al. discloses a hand-held portable crimping tool. U.S. Pat. No. 7,640,780 to Ruland discloses a ram retraction selection. U.S. Pat. No. 8,661,643 to Utecht discloses a portable hand operated hose fitting swaging device.

Accordingly, there is a clearly felt need in the art for a portable hydraulic hose mender crimping device, which allows a hose mender or other hose fitting to be attached to a hose with a portable device without moving the hydraulic hose.

SUMMARY OF THE INVENTION

The present invention provides a portable hydraulic hose mender crimping device, which allows a hose mender or other hose fitting to be attached to a hose with a portable device. The portable hydraulic hose mender crimping device (portable crimping device) preferably includes a support base, a hydraulic cylinder, a hand hydraulic pump, a crimping device and a pair of mounting brackets. The support base is preferably a rectangular tube, but other structures may also be used. A bottom of the pair of mounting brackets are attached to a top of the support base. A bottom of the hand hydraulic pump is attached to a top of the pair of mounting brackets. An opening is formed through one of the pair of brackets to receive an outer perimeter of the hydraulic cylinder. A non-rod end of the hydraulic cylinder is preferably secured to the other one of the pair of brackets. One end of a hydraulic hose is connected to a hydraulic fluid outlet of the hand hydraulic pump and the opposite end of the hydraulic hose is connected to a hydraulic fluid inlet of the hydraulic cylinder. The hydraulic cylinder preferably includes a hollow extension rod. Pumping of the hand hydraulic pump causes the hollow extension rod to move outward from a rod end of the hydraulic cylinder. An external thread is formed on an outer diameter of the hydraulic cylinder, adjacent the rod end thereof.

The crimping device preferably includes a base yoke member, a die pivot member, an actuation base. The base yoke member includes a base portion, a first yoke projection and a second yoke projection. The first yoke projection extends outward from one end and a first side of the base portion. The second yoke projection extends outward from the one end and a second side of the base portion. An actuation slot is formed through the first and second yoke projections to slidably receive the actuation base. The actuation slot also forms a first pivoting leg and a first lock leg, and a second pivoting leg and a second lock leg. A base pivot hole is formed through the first and second pivoting legs. A base lock hole is formed through the first and second lock legs. A body thread is formed in the base portion. The body thread is sized threadably receive the external thread formed on the hydraulic cylinder.

The pivoting yoke member preferably includes a lock projection extending outward from a bottom of one side thereof. A pivot semi-circular die cavity is formed in the one side. One of a pair of crimp dies is retained in the pivot semi-circular die cavity. A pivot hole is formed through a top of the pivoting yoke member. A pivot pin is retained in the base pivot hole and the pivot hole to pivotally engage the base yoke member with the pivoting yoke member. A lock hole is formed through the lock projection. The pivoting yoke member is locked to the base yoke member with a removable locking pin inserted through the base lock hole and the lock hole. The actuation base preferably includes a base member, a rod boss and a location rod. The rod boss extends from one end of the base member and a base semi-circular cavity is formed in an opposing end of the base member. The location rod extends from the rod boss. The location rod is sized to be inserted into the hollow extension rod of the hydraulic cylinder. The other one of the pair of crimp dies is retained in the base semi-circular cavity. Each crimp die preferably includes a semi-circular outer perimeter and a semi-circular inner perimeter. A plurality of axial notches are formed in the inner perimeter. The inner perimeter is sized to receive a mender sleeve.

Accordingly, it is an object of the present invention to provide a portable crimping device, which allows a hose mender or other hose fitting to be attached to a hose with a portable device without moving the hydraulic hose.

These and additional objects, advantages, features and benefits of the present invention will become apparent from the following specification.

DETAILED DESCRIPTION OF THE PREFERRED EMBODIMENTS

Figure 1:
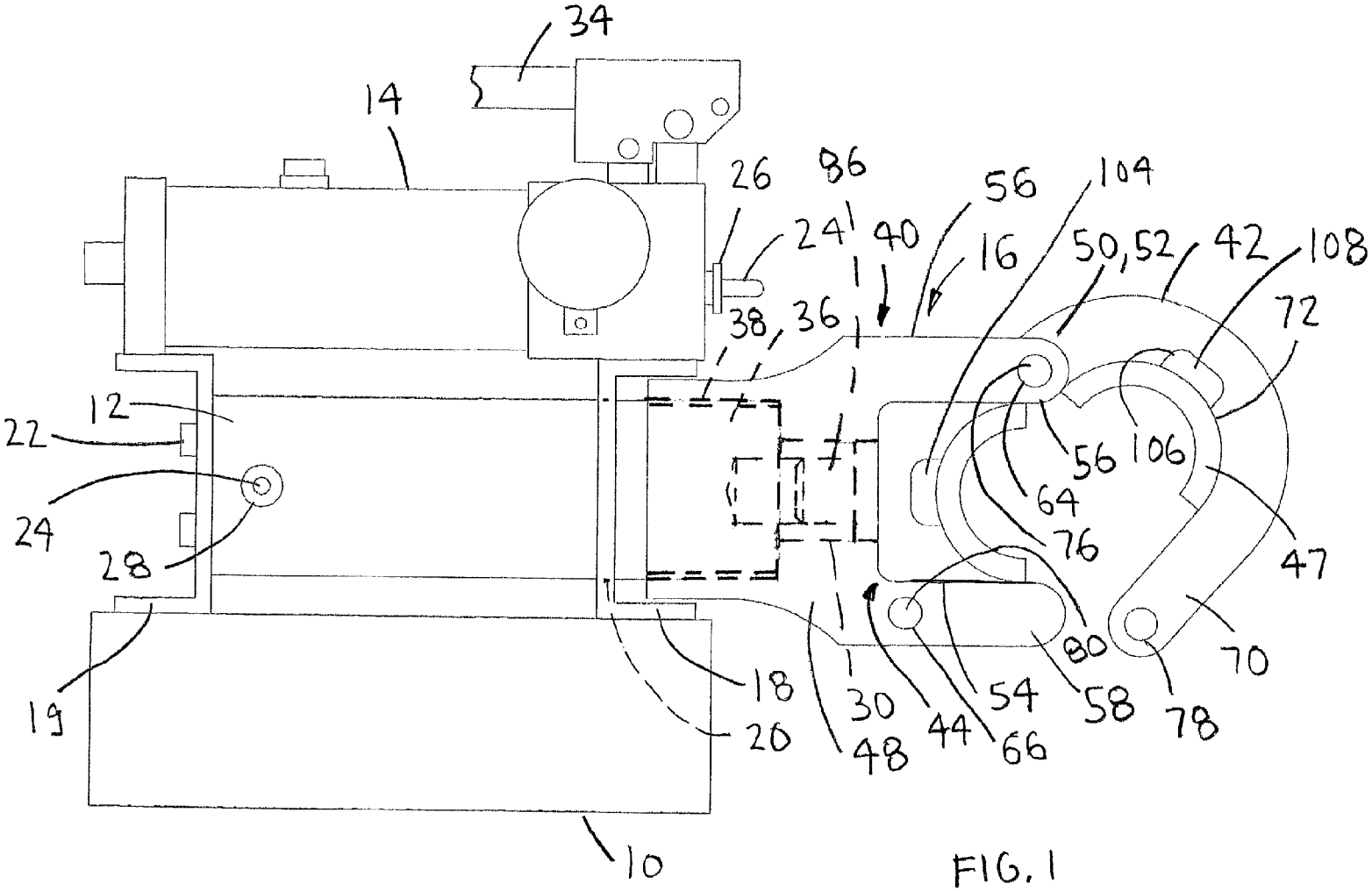
FIG. 1 is a side view of a portable crimping device in accordance with the present invention.
Figure 3:
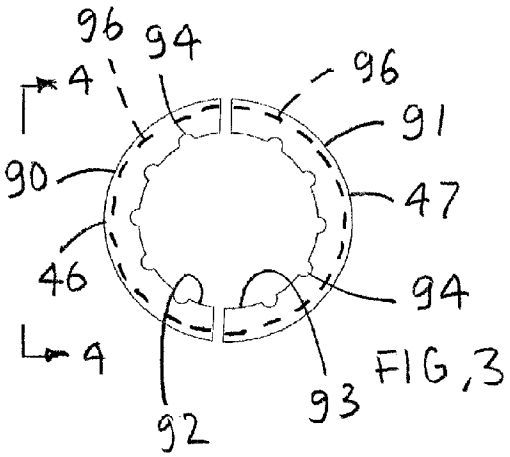
FIG. 3 is a side view of a pair of crimp dies of a portable crimping device in accordance with the present invention.
Figure 4:
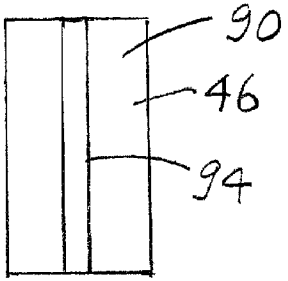
FIG. 4 is a rear view of a crimp die of a portable crimping device in accordance with the present invention.
Figure 2:
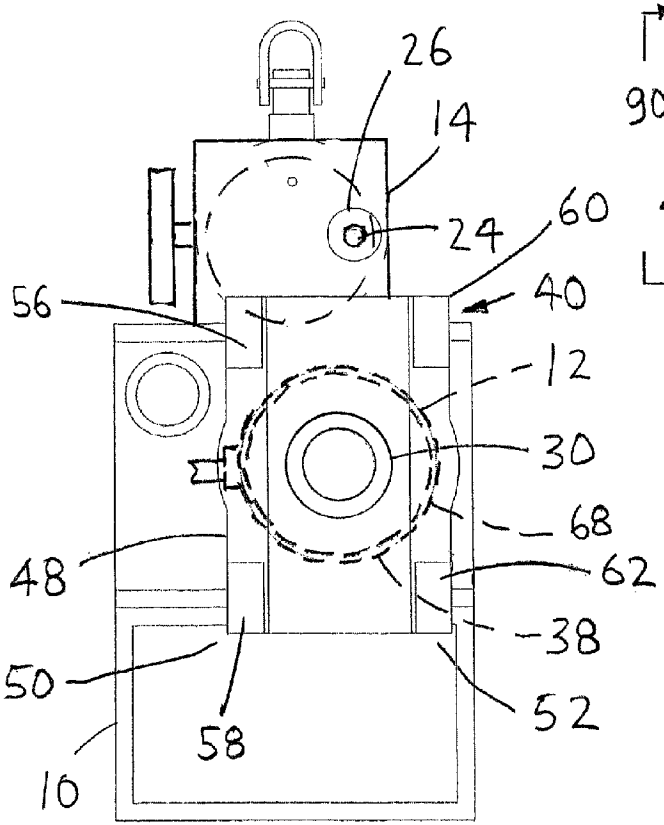
FIG. 2 is an end view of a portable crimping device with a pivoting yoke member removed in accordance with the present invention.
Figure 7:
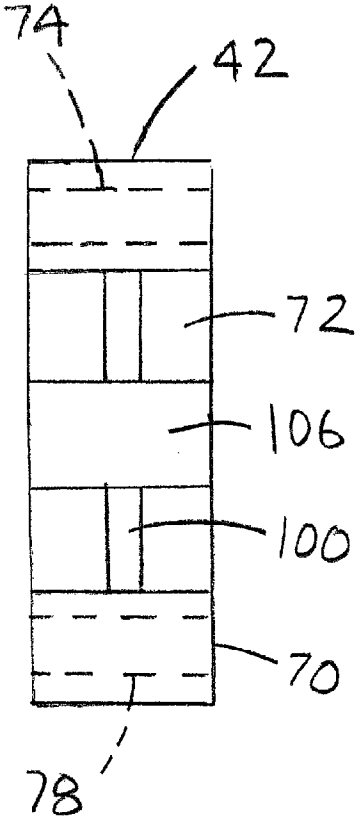
FIG. 7 is a front view of a pivoting yoke member of a portable crimping device in accordance with the present invention.
Figure 6:
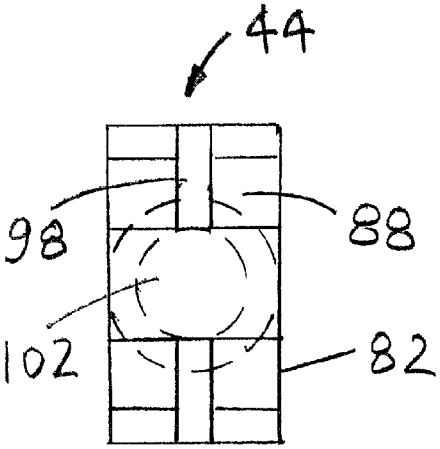
FIG. 6 is a front view of an actuation base of a portable crimping device in accordance with the present invention.
Figure 5:
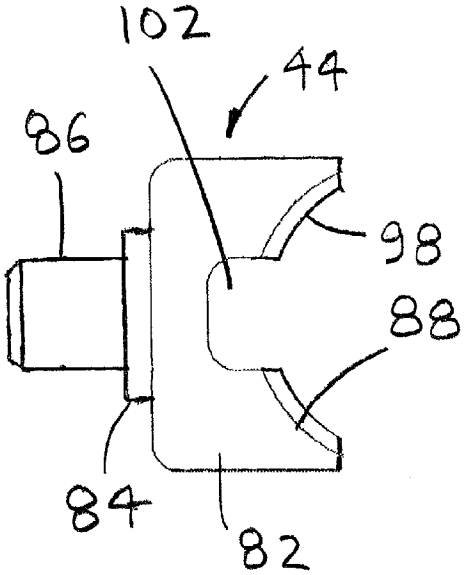
FIG. 5 is a side view of an actuation base of a portable crimping device in accordance with the present invention.

With reference now to the drawings, and particularly to FIG. 1, there is shown a side view of a portable crimping device 1. With reference to FIG. 2, the portable crimping device preferably includes a support base 10, a hydraulic cylinder 12, a hand hydraulic pump 14, a crimping device 16 and a pair of mounting brackets 18, 19. The support base 10 is preferably a rectangular tube, but other structures may also be used. Each mounting bracket 18, 19 is preferably a U-channel, but other structures may also be used. A bottom of the pair of mounting brackets 18 are attached to a top of the support base 10, with welding or fasteners. A bottom of the hand hydraulic pump 14 is attached to a top of the pair of mounting brackets 18 with fasteners or like. A cylinder opening 20 is formed through the bracket 18 to receive an outer perimeter of the hydraulic cylinder 12. A non-rod end of the hydraulic cylinder is preferably secured to the bracket 19 with a plurality of fasteners 22. One end of a hydraulic hose 24 is connected to a hydraulic fluid outlet 26 of the hand hydraulic pump 14 and the opposite end of the hydraulic hose 24 is connected to a hydraulic fluid inlet 28 of the hydraulic cylinder 12. The hydraulic cylinder 12 preferably includes a hollow extension rod 30. Pumping of the hand hydraulic pump 14 with a handle 34 causes the hollow extension rod 30 to move outward from a rod end 36 of the hydraulic cylinder 12. An external thread 38 is formed on an outer diameter of the hydraulic cylinder 12, adjacent the rod end 36 thereof.

With reference to FIGS. 3-7, the crimping device 16 preferably includes a base yoke member 40, a die pivot member 42, an actuation base 44. A pair of crimp dies 46, 47 are retained in the crimping device 16. The base yoke member 40 includes a base portion 48, a first yoke projection 50 and a second yoke projection 52. The first yoke projection extends outward from one end and a first side of the base portion 48. The second yoke projection 52 extends outward from the one end and a second side of the base portion 48. An actuation slot 54 is formed through the first and second yoke projections 50, 52 to slidably receive the actuation base 44. The actuation slot 54 also forms a first pivoting leg 56 and a first lock leg 58, and a second pivoting leg 60 and a second lock leg 62. A base pivot hole 64 is formed through the first and second pivoting legs 56, 60. A base lock hole 66 is formed through the first and second lock legs 58, 62, adjacent the base portion 48. A body thread 68 is formed in substantially the other end of the base portion 48. The body thread 68 is sized to threadably receive the external thread 38 formed on the hydraulic cylinder 12.

The pivoting yoke member 42 preferably includes a lock projection 70 extending outward from a bottom of one side thereof. A pivot semi-circular die cavity 72 is formed in the one side of the die pivot member 42. The crimp die 47 is retained in the pivot semi-circular die cavity 72. A pivot hole 74 is formed through a top of the pivoting yoke member 42. A pivot pin 76 is retained in the base pivot hole 64 and the pivot hole 74 to pivotally engage the base yoke member 40 with the pivoting yoke member 42. A lock hole 78 is formed through the lock projection 70 of the pivoting yoke member 42. The pivoting yoke member 42 is locked to the base yoke member 40 with a removable lock pin 80 inserted through the base lock hole 66 and the lock hole 78. The actuation base 44 preferably includes a base member 82, a rod boss 84 and a location rod 86. The rod boss 84 extends from one end of the base member 82 and a base semi-circular cavity 88 is formed in an opposing end of the base member 82. The location rod 86 extends outward from the rod boss 84. The location rod 86 is sized to be inserted into the hollow extension rod 30 of the hydraulic cylinder 12.

The crimp die 46 is retained in the base semi-circular cavity 88. Each crimp die 46, 47 preferably include a semi-circular outer perimeter 90, 91 and a semi-circular inner perimeter 92, 93. A plurality of axial notches 94 are formed in the inner perimeter 92, 93. The inner perimeter 92, 93 is sized to receive a mender sleeve or other hose fitting. An axial location groove 96 is formed in the semi-circular outer perimeter 90, 91. A base projection 98 extents outward from the base semi-circular cavity 88 to be received by the axial location groove 96 of the crimp die 46. A pivoting projection 100 extends outward from the pivot semi-circular die cavity 72 to be received by the axial location groove 96 of the crimp die 47. The axial location groove 96 prevents axially movement of the crimp dies 46, 47 relative to the actuation base 44 and the pivoting yoke member 42. A base magnet notch 102 is formed in the base semi-circular die cavity 88 to receive a die magnet 104. A pivoting magnet notch 106 is formed in the pivoting semi-circular die cavity 72 to receive a die magnet 108. The die magnet 104 retains the crimp die 46 in the base semi-circular cavity 88. The die magnet 106 retains the crimp die 47 in the pivot semi-circular die cavity 72.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A portable crimping device comprising:

a hydraulic pump having a hydraulic output;

a hydraulic cylinder having a rod located at a rod end, said rod is capable of axially movement, said hydraulic cylinder includes a hydraulic input which is connected to said hydraulic output wherein said hydraulic pump and cylinder are parallel; and a crimping device includes a base yoke member, a die pivot member and an actuation base, said base yoke member includes an actuation slot, said base yoke member is secured to said rod end of said hydraulic cylinder, said die pivot member having a first portion pivotally engaged with said base yoke member, a second portion of said die pivot member is capable of being locked to said base yoke member, said die pivot member includes a pivot cavity capable of receiving a pivot crimp die, said actuation base semi-circular is slidably retained in said actuation slot, said actuation base includes a base cavity capable of receiving a base crimp die, wherein said hydraulic pump is operated to cause said rod of said hydraulic cylinder to decrease a distance between said actuation base and said die pivot member.

2. The portable crimping device of claim 1 wherein:

said hydraulic pump is a hand operated hydraulic pump.

3. The portable crimping device of claim 1, further comprising:

a support base having two brackets extending upward, said hydraulic cylinder is retained in said two brackets, said hydraulic pump is attached to said two brackets.

4. The portable crimping device of claim 1 wherein:

said hydraulic cylinder includes a hollow rod.

5. The portable crimping device of claim 4 wherein:

said actuation base includes a base member and a location rod, said location rod extends from one end of said rod base, said location rod is sized to received by said hollow rod, a base semicircular cavity is formed in an opposing end of said base member, said base semi-circular cavity is sized to receive said base crimp die.

6. The portable crimping device of claim 5 wherein: an axial projection extends from said base semi-circular cavity, an axial location groove is formed in an outer perimeter of said base crimp die to receive said axial projection, said axial projection prevents axial movement of said base crimp die relative to said actuation base.

7. The portable crimping device of claim 1 wherein:

said crimp die includes a substantially semi-circular outer perimeter and a substantially semi-circular inner perimeter, a plurality of axial notches are formed in said substantially semicircular inner perimeter.

8. A portable crimping device comprising:

a hydraulic pump having a hydraulic output;

a hydraulic cylinder having a rod located at a rod end, said rod is capable of axially movement, said hydraulic cylinder includes a hydraulic input which is connected to said hydraulic output; and a crimping device includes a base yoke member, a die pivot member and an actuation base, said base yoke member includes an actuation slot and a base magnet, said base yoke member is secured to said rod end of said hydraulic cylinder, said die pivot member having a first portion pivotally engaged with said base yoke member, a second portion is capable of being locked to said base yoke member, said die pivot member includes a pivot cavity capable of retaining a pivot crimp die, said actuation base is slidably retained in said actuation slot, said die pivot member includes a pivot magnet, said actuation base includes a base cavity capable of retaining a base crimp die, wherein said hydraulic pump is operated to cause said rod of said hydraulic cylinder to decrease a distance between said actuation base and said die pivot member.

9. The portable crimping device of claim 8 wherein: said hydraulic pump is a hand operated hydraulic pump.

10. The portable crimping device of claim 8, further comprising:

a support base having two brackets extending upward, said hydraulic cylinder is retained in said two brackets, said hydraulic pump is attached to said two brackets.

11. The portable crimping device of claim 8 wherein: said hydraulic cylinder includes a hollow rod.

12. The portable crimping device of claim 11 wherein: said actuation base includes a base member and a location rod, said location rod extends from one end of said rod base, said location rod is sized to received by said hollow rod, a base semicircular cavity is formed in an opposing end of said base member, said base semi-circular cavity is sized to receive said base crimp die.

13. The portable crimping device of claim 12 wherein: an axial projection extends from said base semi-circular cavity, an axial location groove is formed in an outer perimeter of said base crimp die to receive said axial projection, said axial projection prevents axial movement of said base crimp die relative to said actuation base.

14. The portable crimping device of claim 8 wherein:

said crimp die includes a substantially semi-circular outer perimeter and a substantially semi-circular inner perimeter, a plurality of axial notches are formed in said substantially semicircular inner perimeter.

15. A portable crimping device comprising:

a hydraulic pump having a hydraulic output;

a hydraulic cylinder having a rod, said rod is capable of axially movement and located at a rod end, said hydraulic cylinder includes a hydraulic input which is connected to said hydraulic output, wherein said hydraulic pup and cylinder are parallel; and a crimping device includes a base yoke member, a die pivot member and an actuation base, said base yoke member includes an actuation slot, said base yoke member is secured to said rod end of said hydraulic cylinder, said die pivot member having one side pivotally engaged with said base yoke member, a lock projection extends from an opposing side of said die pivot member, said lock projection is capable of being locked to said base yoke member, said die pivot member includes a pivot cavity capable of receiving a pivot crimp die, said actuation base is slidably retained in said actuation slot said actuation base includes a base cavity having a semi-circular shape and is capable of receiving a base crimp die, wherein said hydraulic pump is operated to cause said rod of said hydraulic cylinder to decrease a distance between said actuation base and said die pivot member.

16. The portable crimping device of claim 15 wherein: said hydraulic pump is a hand operated hydraulic pump.

17. The portable crimping device of claim 15, further comprising:

a support base having two brackets extending upward, said hydraulic cylinder is retained in said two brackets, said hydraulic pump is attached to said two brackets.

18. The portable crimping device of claim 15 wherein: said hydraulic cylinder includes a hollow rod.

19. The portable crimping device of claim 18 wherein: said actuation base includes a base member and a location rod, said location rod extends from one end of said rod base, said location rod is sized to received by said hollow rod, a base semicircular cavity is formed in an opposing end of said base member, said base semi-circular cavity is sized to receive said base crimp die.

20. The portable crimping device of claim 19 wherein: an axial projection extends from said base semi-circular cavity, an axial location groove is formed in an outer perimeter of said base crimp die to receive said axial projection, said axial projection prevents axial movement of said base crimp die relative to said actuation base.

* * * * *